US005651475A

United States Patent [19]

Fenton

[11] Patent Number: 5,651,475

[45] Date of Patent: Jul. 29, 1997

[54] CANDY DISPENSER

[76] Inventor: Darryl Fenton, 3201 Whispering Woods Dr., Wasilla, Ak. 99654

[21] Appl. No.: 529,724

[22] Filed: Sep. 18, 1995

[51] Int. Cl.[6] ..... A24F 15/04

[52] U.S. Cl. ..... 221/24; 221/289

[58] Field of Search ..... 221/24, 289, 232, 221/268, 272, 276; 446/475, 340, 73

[56] References Cited

U.S. PATENT DOCUMENTS

| | | | |
|---|---|---|---|
| 868,632 | 10/1907 | Almstrom et al. | 221/24 |
| 2,506,719 | 5/1950 | Gregg | 221/24 |
| 4,311,251 | 1/1982 | Sternberg | 221/24 |

FOREIGN PATENT DOCUMENTS

| | | | |
|---|---|---|---|
| 805137 | 7/1951 | Germany | 221/24 |

*Primary Examiner*—Kenneth Noland
*Attorney, Agent, or Firm*—Michael J. Tavella

[57] ABSTRACT

A dispenser for candy or other objects that is formed in the shape of an animal. Any large animal body can be used. The body of the animal is hollow and acts as a storage bin for the candy or other dispensing material. A hole is formed in the rear, lower portion of the body. A sliding gate that covers the hole to prevent the dispensing items from being dispensed is used to operate the dispenser. The head is attached to the body at a pivot point. The sliding gate is attached to the head. When the head is lifted, the sliding gate is pulled forward, which opens the hole that allows a number of candy pieces or other items to be dispensed. Pushing down on the head slides the gate back, covering the hole, and preventing further dispensing. A spring can be installed between the head and the body to pull the head down, ensuring that the gate returns to its closed position, ready for the next operation.

13 Claims, 4 Drawing Sheets

CANDY DISPENSER

This invention relates to candy dispensers and particularly to candy dispensers having an animal shape.

BACKGROUND OF THE INVENTION

Numerous candy dispensers have been created over the years that involve animal shapes. Many of these dispensers are shaped as chickens and have mechanisms that simulate laying eggs. Examples of such devices are found in U.S. Pat. No. 2,479,488, which operates by feeding a number of simulated eggs, which are stored within the device, through an opening in the rear of the toy. A spring loaded gate is used to hold the eggs in place and, when operated, to allow one egg to pass from the chicken. A similar device is found in U.S. Pat. No. 1,783,511 that is a duck that dispenses eggs by rocking the duck up and down. Other examples are found in U.S. Pat. Nos. 1,569,637, 2,514,450, and 2,361,196 (which is shaped like a rabbit). Another series of inventions involves animal cigarette dispensers. These devices dispense cigarettes, which are stored in the dispenser, through an outlet. Typically, the device is operated by raising the tail or by pushing on the head or ear of the animal. Examples of these devices are found in U.S. Pat. Nos. 3,189,216 and 2,506,719.

All of these devices are designed to dispense one item at a time, whether it is a cigarette, egg or other item. To do this, the operating mechanisms are complex. The systems advance one item for dispensing while simultaneously preventing the other items from advancing. Such mechanisms are expensive to build and are prone to failure and jamming.

SUMMARY OF THE INVENTION

The present invention eliminates the cause of all these problems. It does not dispense only one item at a time. Accordingly, its operating mechanism is simple and reliable. The invention has the shape of an animal. In this application, a moose is shown. Obviously, any large animal body can be used. The body of the animal has a hollow cavity that acts as a storage bin for the candy or other dispensing material. A hole is formed in the rear, lower end of the body. A sliding gate is provided that covers the hole to prevent the dispensing items from being dispensed. The sliding gate runs the length of the body and attaches to the lower portion of the animal's head. The head is attached to the body at a pivot point that allows the head to pivot. Thus, when the head is lifted, the sliding gate is pulled forward, thereby opening the hole, which then allows a number of candy pieces or other items to be dispensed. Pushing down on the head slides the gate back, covering the hole, and preventing further dispensing. To assist the gate in its operation, a spring can be installed between the head and the body. The spring ensures that the gate returns to its closed position, ready for the next operation.

It is an object of this invention to produce a candy dispenser in the shape of an animal that allows dispensing of any quantity of item desired.

It is another object of this invention to produce a candy dispenser in the shape of an animal that has a simple operating mechanism.

It is yet another object of the invention to produce a candy dispenser in the shape of an animal that can be manufactured for a minimal cost.

DETAILED DESCRIPTION OF THE INVENTION

Figure 1:
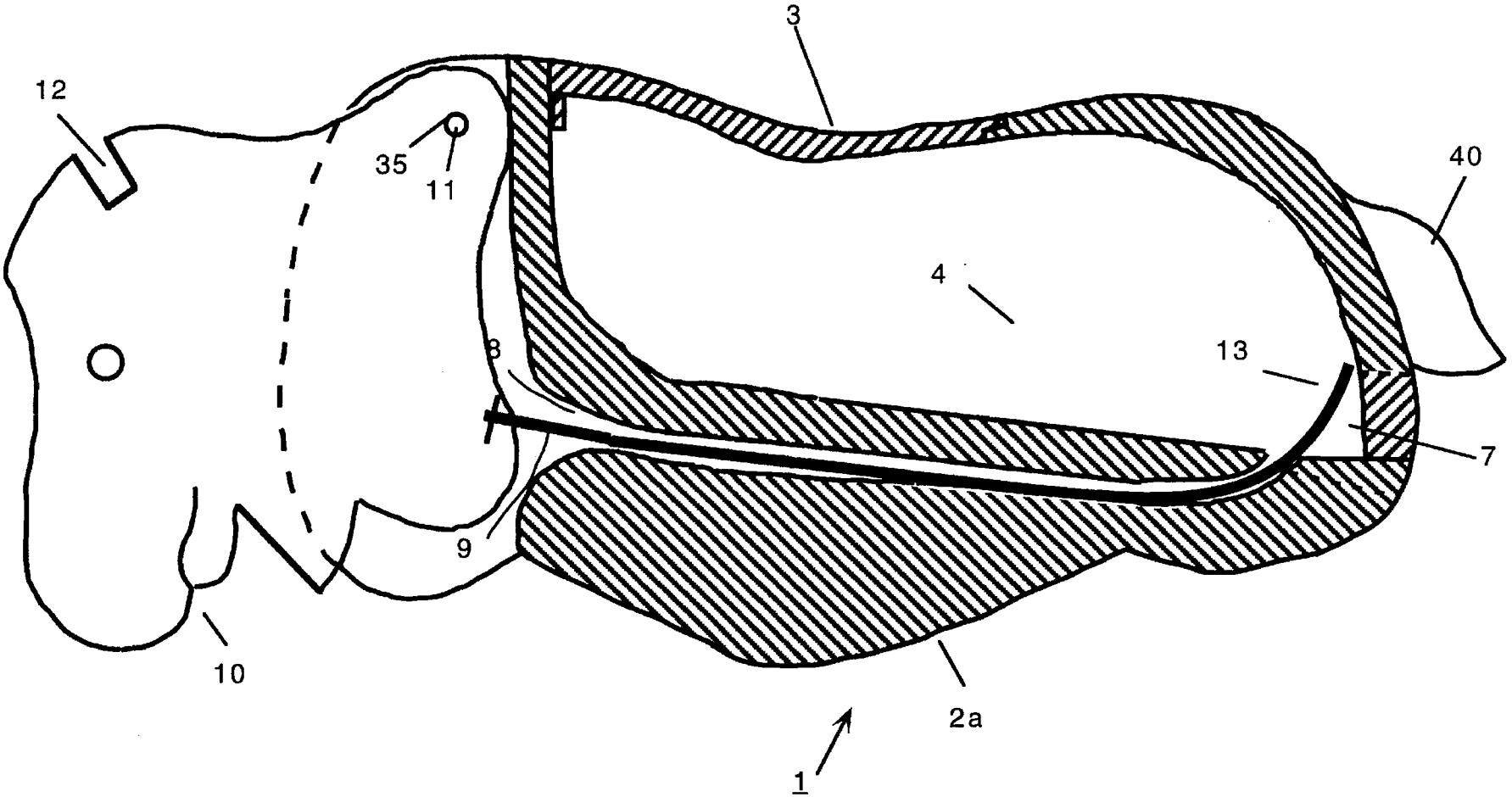
FIG. 1 is a cross-sectional side view of the invention.
Figure 2:
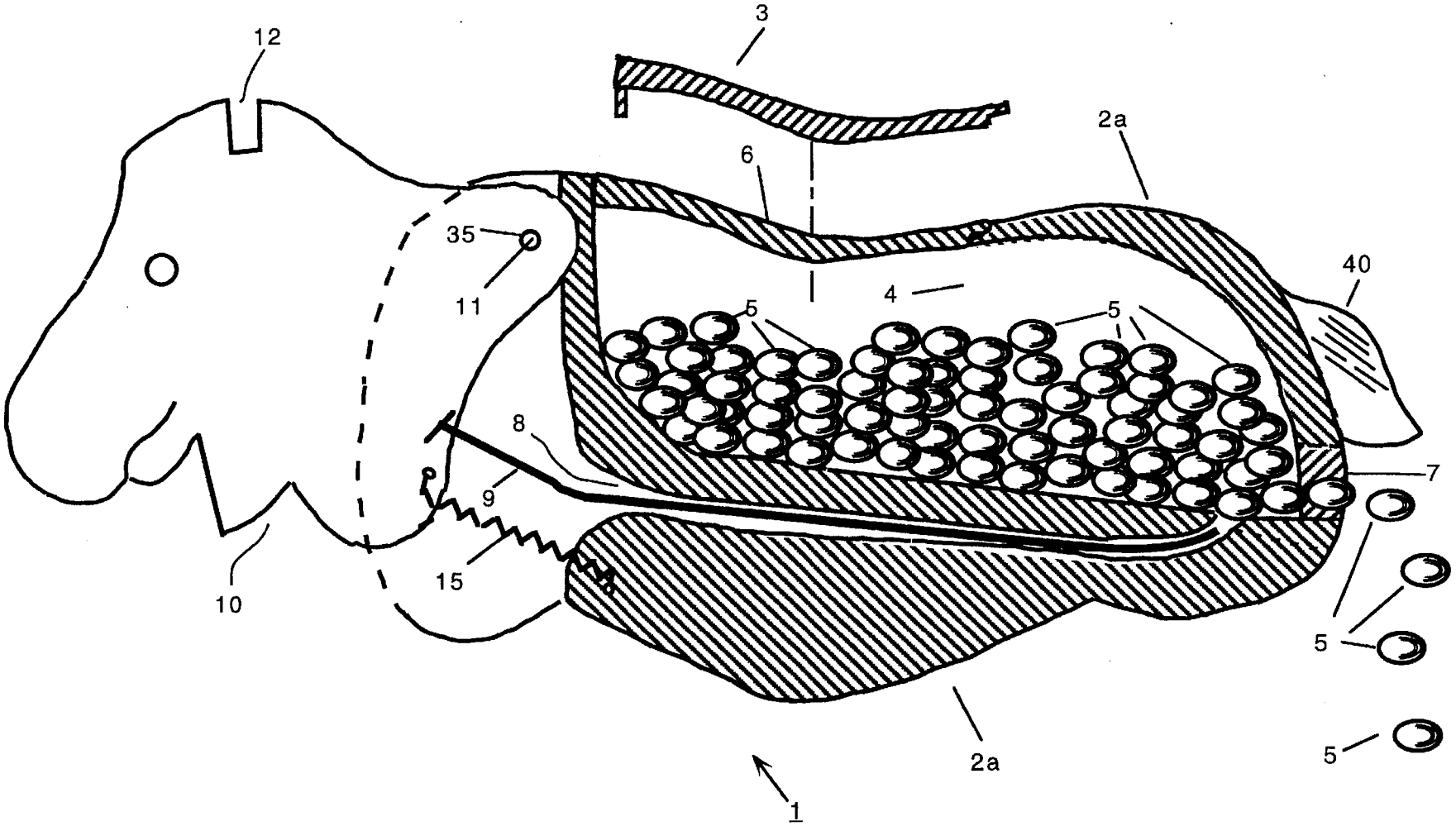
FIG. 2 is a cross-sectional side view of the invention showing the head tilted in the position for dispensing from the invention.
Figure 3:
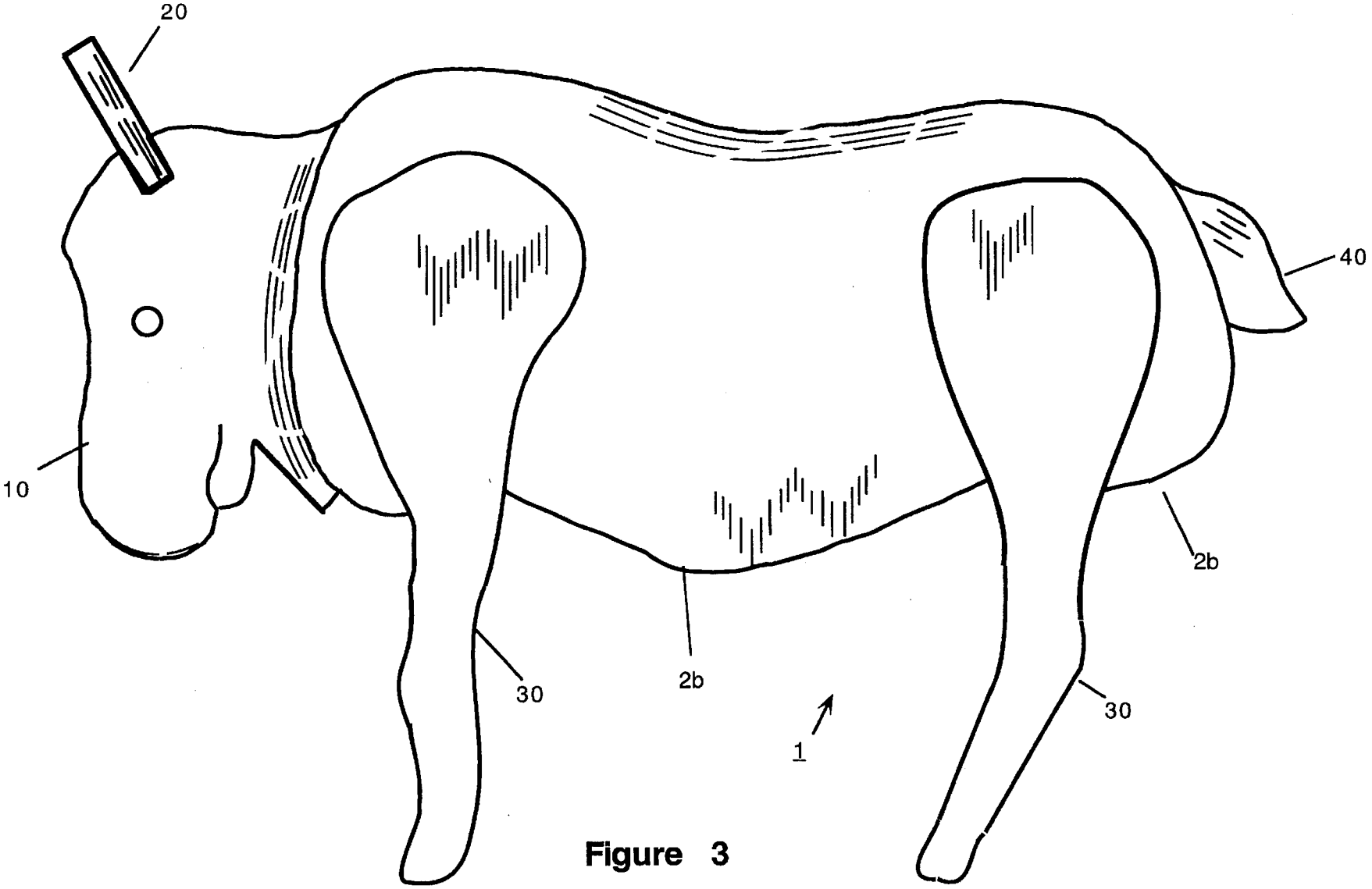
FIG. 3 is a side view of the invention showing the legs that support the body.

Referring now to FIGS. 1 and 2, a cross-sectional view of the invention is shown. In these figures, the invention is shown in the form of a moose. Any other animal form can be used by forming the operating mechanism within whatever body shape is desired. The dispenser 1 has a body 2. The body 2 has an outer form in the general shape of an animal. The body 2 is also formed of two separate pieces. FIGS. 1 and 2 show the right side **2*a* of the body 2. The left side 2*b* is shown in FIG. 3. Each side of the body 2 has a number of openings formed therein: an inner cavity 4, a channel 8, and an exit hole 7**. These features are discussed in greater detail below.

At the top of the body 2 is a removable lid 3 (see FIG. 2). The lid 3 provides access to the inner cavity 4 formed in the body 2 to store the dispensing items 5. The dispensing items 5 can be any small items such as candy, coins, small toys, etc. The dispensing items 5 are stored in the inner cavity 4 as shown and are loaded into the inner cavity 4 through the lid opening 6. An exit hole 7 is cut into the body 2 as shown. The exit hole 7 penetrates into the inner cavity 4. When the exit hole 7 is open, the dispensing items 5 can fall out of the dispenser 1 through the exit hole 7. See FIG. 2.

A channel 8 is formed in the body 2 under the inner cavity 4. The channel 8 is used to hold a sliding gate 9. The sliding gate 9 is a long, thin strip of flexible material. A formed head 10 is attached to the body 2 at a pivot point 11 as shown. The formed head 10 can thus pivot about the pivot point 11. The method of assembly is discussed below. In FIGS. 1 and 2, a slot 12 is shown in the top of the formed head 10 for antlers 20 (see FIG. 3). The sliding gate 9 is attached to the bottom of the formed head 10 as shown. The sliding gate 9 can be attached using any one of many common fasteners such as staples, screws, nails, etc.

FIG. 1 shows the device in the ready position. In this position, the formed head 10 is in the down position and the sliding gate 9 is in the up or closed position. Note that the end 13 of the sliding gate 9 covers the exit hole 7, thereby preventing the dispensing items 5 from leaving the dispenser 1.

Referring now to FIG. 2, the formed head 10 is in the up position. The sliding gate 9 is pulled forward as shown, thereby opening the exit hole 7, thereby allowing the dispensing items 5 to be dispensed from the exit hole 7 as shown. To close the exit hole 7 the formed head 10 is pivoted back to the down position of FIG. 1. This causes the sliding gate 9 to be slid back over the exit hole 7 as shown in FIG. 1.

A return spring 15 can be added as an option as shown in FIGS. 1 and 2. The return spring 15 aids in returning the formed head 10 to the down position of FIG. 1.

FIG. 3 shows a side view of the complete dispenser. Legs 30 are attached to the body 2 as shown to support the device on a level surface. In this view, the outside of the left body side **2*b*** is shown.

Figure 4:
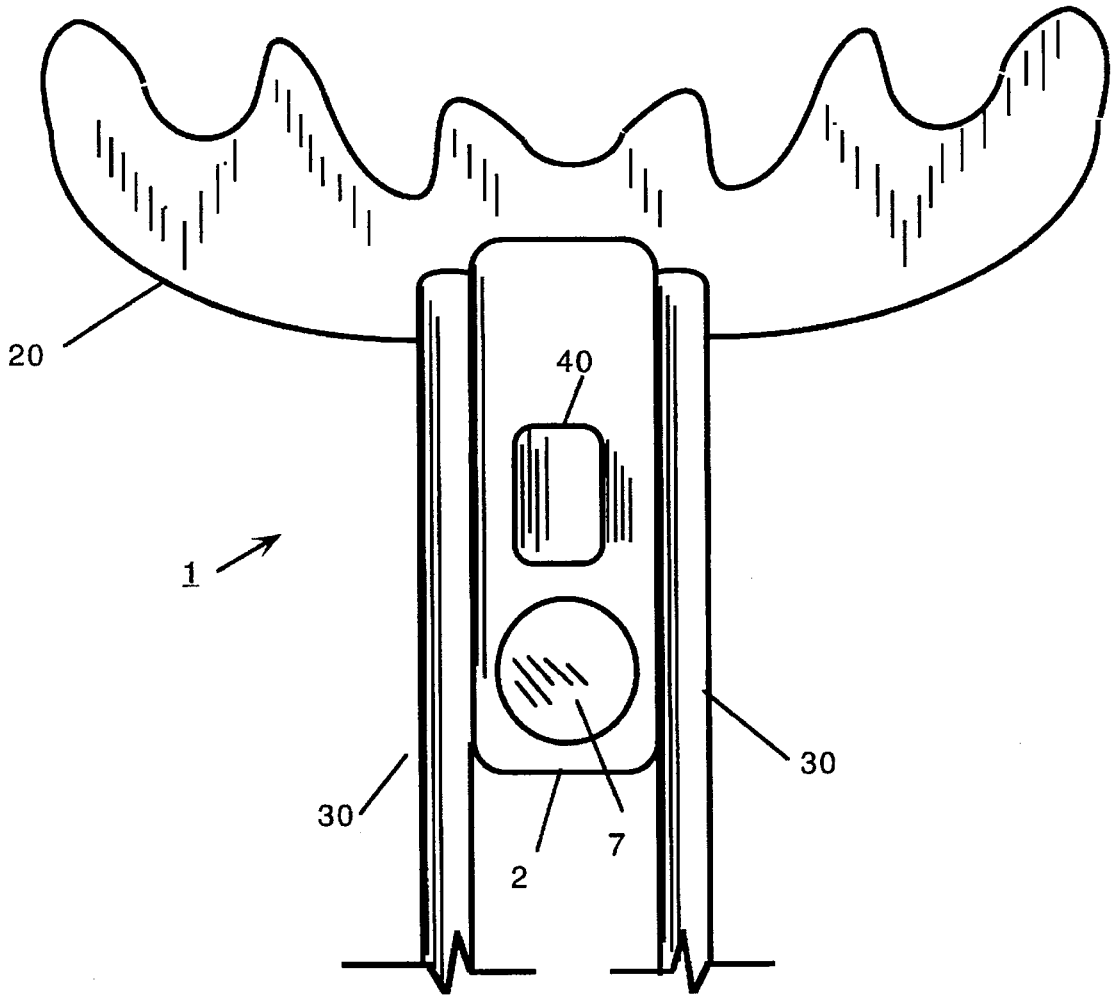
FIG. 4 is a rear view of the invention.

FIG. 4 shows a rear view of the device. The antlers 20 are attached to the head in the slot 12 as shown. The tail 40 (see also FIGS. 1, 2 and 3) is also shown. See also FIGS. 1 and 3. Of course, for other animal designs, the characteristics such as antlers, horns or ears change accordingly.

The dispenser 1 is assembled by placing the formed head 10 on the pivot point 11. The pivot point 11 can be a simple post or a dowel that is attached to one side of the body 2. The formed head 10 has a hole 35 that fits over the pivot point 11. The sliding gate 9 is then placed in the channel 8 and attached to the formed head 10. If desired, the return spring 15 can be attached to the formed head 10 and the body 2 as shown. Then, the remaining side of the body 2 is placed over the components and the two body sides 2*a* and 2*b* are attached and secured. The legs 30 and antlers 20 can be added. Finally, inner cavity 4 can be filled the dispensing items 5 and the lid 3 can then be placed on the body 2. The dispenser 1 is then ready to use.

The dispenser 1 can be made from wood, with the cavity and channels cut by a router or other hand tools. It can also be molded from plastic and assembled as discussed above. Any other suitable materials may also be used.

To use the dispenser 1, pivot the formed head 10 upward and the sliding gate 9 is automatically pulled down, thereby opening the exit hole 7. The dispensing items 5 are then automatically dispensed. To stop dispensing, the formed head 10 is pushed down, thereby pushing the sliding gate 9 back over the exit hole 7.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A dispenser for a plurality of dispensable items comprising:

a) a body, said body having an inner cavity to hold the plurality of dispensable items, said body also having an exit hole formed therein, said exit hole being in communication with said inner cavity;

b) a head, pivotably attached to said body;

c) a sliding gate, fixedly attached to said head and also being slidably installed within said body, said sliding gate being positioned such that when said head is in a first position, said sliding gate covers said exit hole, thereby preventing the dispensing of said plurality of dispensable items, and further such when said head is in a second position, said sliding gate does not cover said exit hole, thereby permitting the dispensing of said plurality of dispensable items; and d) wherein said body also has a channel formed therein, and further such that said sliding gate is placed within said channel and is slidably engaged within said channel.

2. The dispenser of claim 1 further comprising at least two leg supports, fixedly attached to said body to hold said body above a surface plane.

3. The dispenser of claim 1 further comprising: a return spring, mounted to said head and said body such that said head, when placed in said second position extends said return spring, thereby causing said head to return to said first position.

4. The dispenser of claim 1 wherein said body and head form a shape of an animal.

5. The dispenser of claim 4 wherein the shape of the animal is a moose.

6. A dispenser for a plurality of dispensable items comprising:

a) a body, said body having an inner cavity to hold the plurality of dispensable items, said body also having an exit hole formed therein, said exit hole being in communication with said inner cavity;

b) a head, pivotably attached to said body;

c) a lid, removably attached to said body, for loading said inner cavity with said plurality of dispensable items;

d) a sliding gate, fixedly attached to said head and also being slidably installed within said body, said sliding gate being positioned such that when said head is in a first position, said sliding gate covers said exit hole, thereby preventing the dispensing of said plurality of dispensable items, and further such when said head is in a second position, said sliding gate does not cover said exit hole, thereby permitting the dispensing of said plurality of dispensable items; and e) a channel formed within said body such that said sliding gate is slidably positioned within said channel.

7. The dispenser of claim 6 further comprising at least two leg supports, fixedly attached to said body to hold said body above a surface plane.

8. The dispenser of claim 6 further comprising: a return spring, mounted to said head and said body such that said head, when placed in said second position extends said return spring, thereby causing said head to return to said first position.

9. The dispenser of claim 6 wherein said body and head form a shape of an animal.

10. The dispenser of claim 9 wherein the shape of an animal is a moose.

11. A dispenser for a plurality of dispensable items comprising:

a) a body, said body having an inner cavity to hold the plurality of dispensable items, said body also having an exit hole formed therein, said exit hole being in communication with said inner cavity;

b) a head, pivotably attached to said body;

c) at least two leg supports, fixedly attached to said body to hold said body above a surface plane;

d) a lid, removably attached to said body, for loading said inner cavity with said plurality of dispensable items;

e) a sliding gate, fixedly attached to said head and being slidably installed within said body, said sliding gate being positioned such that when said head is in a first position, said sliding gate covers said exit hole, thereby preventing the dispensing of said plurality of dispensable items, and further such when said head is in a second position, said sliding gate does not cover said exit hole, thereby permitting the dispensing of said plurality of dispensable items;

f) a return spring, mounted to said head and said body such that said head, when placed in said second position extends said return spring, thereby causing said head to return to said first position; and g) a channel formed within said body such that said sliding gate is slidably positioned within said channel.

12. The dispenser of claim 11 wherein said body and head form a shape of an animal.

13. The dispenser of claim 12 wherein the shape of an animal is a moose.

* * * * *